US011352201B2

(12) United States Patent
Pan et al.

(10) Patent No.: US 11,352,201 B2
(45) Date of Patent: Jun. 7, 2022

(54) PERIPHERAL SEALING ASSEMBLY FOR AN INTERNAL FLOATING ROOF

(71) Applicant: JING KAI INDUSTRIAL CO., LTD., Kaohsiung (TW)

(72) Inventors: Wen-Pin Pan, New Taipei (TW); Shu-Wen Yen, New Taipei (TW)

(73) Assignee: Jing Kai Industrial Co., Ltd., Kaohsiung (TW)

( * ) Notice: Subject to any disclaimer, the term of this patent is extended or adjusted under 35 U.S.C. 154(b) by 100 days.

(21) Appl. No.: 16/867,880

(22) Filed: May 6, 2020

(65) Prior Publication Data

US 2021/0206563 A1 Jul. 8, 2021

(30) Foreign Application Priority Data

Jan. 8, 2020 (TW) ..... 109100605

(51) Int. Cl.
*B65D 88/42* (2006.01)

(52) U.S. Cl.
CPC ..... *B65D 88/42* (2013.01)

(58) Field of Classification Search
CPC ..... B65D 88/34; B65D 88/42; B65D 88/36; B65D 88/38; B65D 88/40; B65D 88/46; B65D 88/48; B65D 88/50; B65D 81/245
See application file for complete search history.

(56) References Cited

U.S. PATENT DOCUMENTS 1,493,091 A * 5/1924 Wiggins ..... B65D 88/34 220/218
1,520,991 A * 12/1924 Wiggins ..... B65D 88/34 220/219
3,647,113 A * 3/1972 Belleli ..... B65D 88/34 220/219
3,690,502 A * 9/1972 Guber, Jr. ..... B65D 88/34 220/219
3,724,705 A * 4/1973 McKibbin ..... B65D 88/48 220/225
3,762,690 A * 10/1973 Harrington ..... B01F 7/22 366/249

(Continued)

FOREIGN PATENT DOCUMENTS

| | | |
|---|---|---|
| CN | 209871293 U | 12/2019 |
| TW | M562279 U | 6/2018 |
| WO | 9608427 A1 | 3/1996 |

OTHER PUBLICATIONS

Search Report appended to an Office Action, which was issued to Taiwanese counterpart application No. 109100605 by the TIPO dated May 25, 2020, with an English translation thereof.

*Primary Examiner* — Kareen K Thomas

(57) ABSTRACT

A peripheral sealing assembly for connection with a buoyant panel unit usable in a liquid storage tank includes a fixing frame, an enclosure, and a buffer pipes. The fixing frame connects the buoyant panel unit. The enclosure is fixed to the fixing frame to sealingly contact an inner surrounding wall of the liquid storage tank. The enclosure defines a looped receiving space between the inner surrounding wall and the buoyant panel unit. The buffer pipes are inserted into the looped receiving space. Each buffer pipe is hollow, extends along the looped receiving space and has a lengthwise outer peripheral surface fixed to the lengthwise outer peripheral surfaces of two adjacent other buffer pipes.

8 Claims, 5 Drawing Sheets

(56) References Cited

U.S. PATENT DOCUMENTS

| | | | | |
|---|---|---|---|---|
| 3,892,332 | A * | 7/1975 | Iwagami | B65D 88/34 220/219 |
| 4,230,138 | A * | 10/1980 | Tanaka | B65D 88/34 114/256 |
| 4,842,160 | A * | 6/1989 | Piso | B65D 88/48 220/225 |
| 10,478,648 | B2 | 11/2019 | Basseches | |
| 2012/0091135 | A1* | 4/2012 | Ben Afeef | B65D 88/40 220/220 |

* cited by examiner

PERIPHERAL SEALING ASSEMBLY FOR AN INTERNAL FLOATING ROOF

CROSS-REFERENCE TO RELATED APPLICATION

This application claims priority to Taiwanese Patent Application No. 109100605, filed on Jan. 8, 2020.

FIELD

The disclosure relates to a peripheral sealing assembly for connection with an internal floating roof usable in a liquid storage tank.

BACKGROUND

A fluid storage tank and an internal floating roof both are high stiffness and hardness structures. To enable proper movement of the internal floating roof within the fluid storage tank, a resilient sealing member is needed to be disposed around the internal floating roof and to abut the fluid storage tank. When the internal floating roof moves in the fluid storage tank, the resilient sealing member not only buffers impacts but also compensates for a seal of the gap between the internal floating roof and the fluid storage tank to reduce formation of volatile organic compounds (VOCs).

FIG. 1 illustrates a buoyant panel unit 11 of an internal floating roof 1 and a sealing assembly 12 connecting a rounded periphery of the buoyant panel unit 11. The buoyant panel unit 11 includes a plurality of floating members 111 cooperatively defining the rounded periphery of the buoyant panel unit 11. The sealing assembly 12 includes a fixing frame 121 connected to the rounded periphery defined by the floating members 111, an enclosure 122 having two opposite end portions fixed to the fixing frame 121, and a cylindrically solid sponge 123 wrapped by the enclosure 122. The enclosure 122 is stretched and expanded by the solid sponge 123 to abut an inner surrounding wall (not shown) of a liquid storage tank (not shown), so that the sealing assembly 12 can prevent liquid from leaking and evaporating through the gap between the internal floating roof 1 and the inner surrounding wall of the fluid storage tank. The solid sponge 123 is made from a polyurethane (PU) foam material. When the sealing assembly 12 moves upward and downward together with the internal floating roof 1 within the liquid storage tank, the solid sponge 123 is compressed and provides a sealing-and-buffering effect. However, there is still a room to provide an improvement over the sealing assembly employing the solid sponge 123. In addition, as the solid sponge 123 immersed in the liquid of the fluid storage tank for a long time can absorb the liquid, it easily disintegrates and become precipitated in the storage tank. As a result, the liquid can be contaminated, and a delivery pump for delivering the liquid can be damaged.

SUMMARY

Therefore, an object of the disclosure is to provide a peripheral sealing assembly with increased buffering effects, and improved buoyancy and sealing capabilities.

According to the disclosure, a peripheral sealing assembly for connection with a buoyant panel unit of an internal floating roof usable in a liquid storage tank includes a fixing frame, an enclosure, and a plurality of buffer pipes.

The fixing frame is configured to extend around and connect a periphery of the buoyant panel unit.

The enclosure is fixed to the fixing frame and is configured to sealingly contact an inner surrounding wall of the liquid storage tank. The enclosure defines a looped receiving space.

The buffer pipes are inserted into the looped receiving space. Each of the buffer pipes is hollow, extends along the looped receiving space, and has a lengthwise outer peripheral surface fixed to the lengthwise outer peripheral surfaces of two adjacent ones of the buffer pipes.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
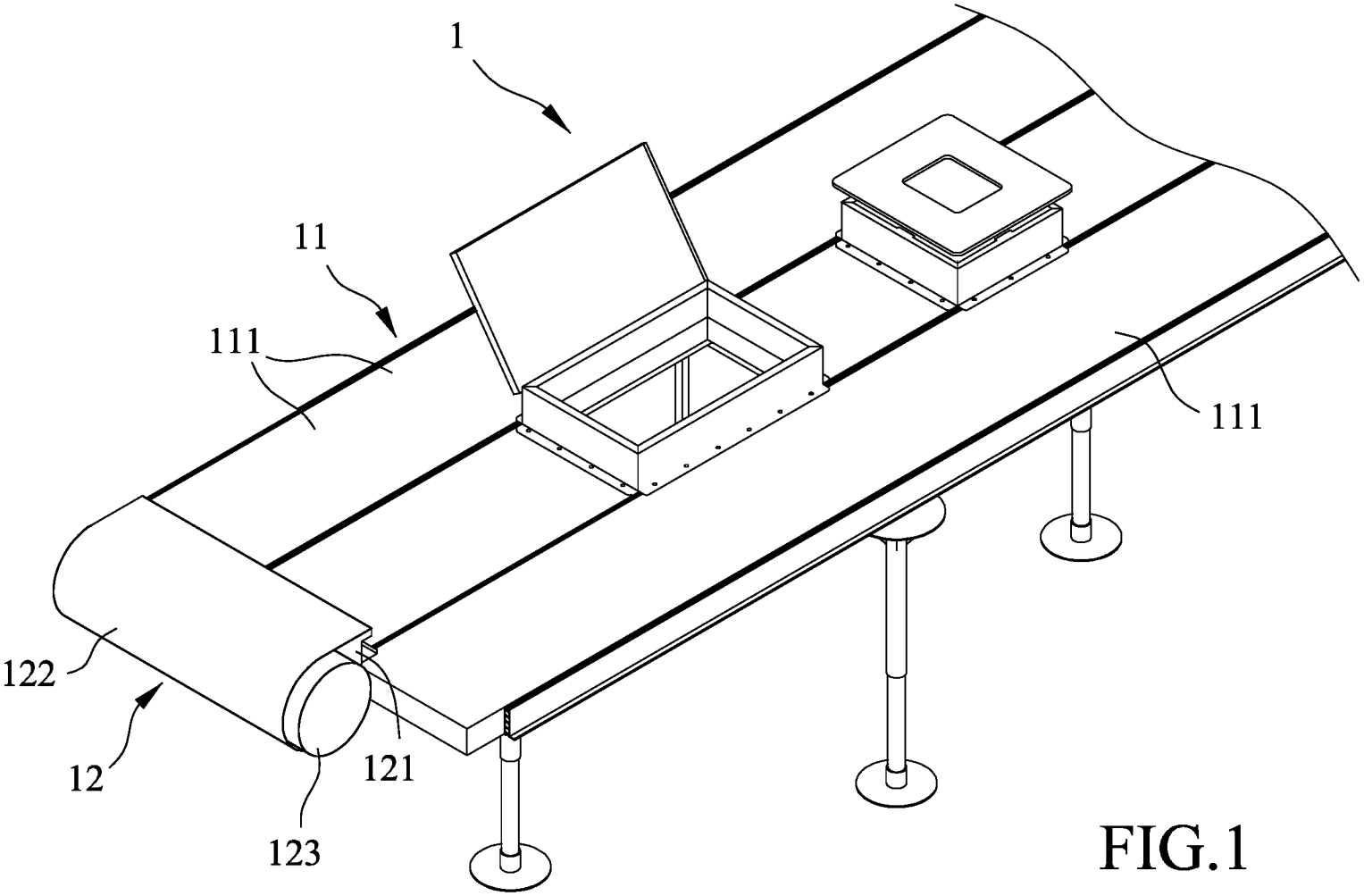
FIG.1 PRIOR ART
FIG. 1 is a fragmentary perspective view of an existing sealing assembly connecting to an internal floating roof.
Figure 2:
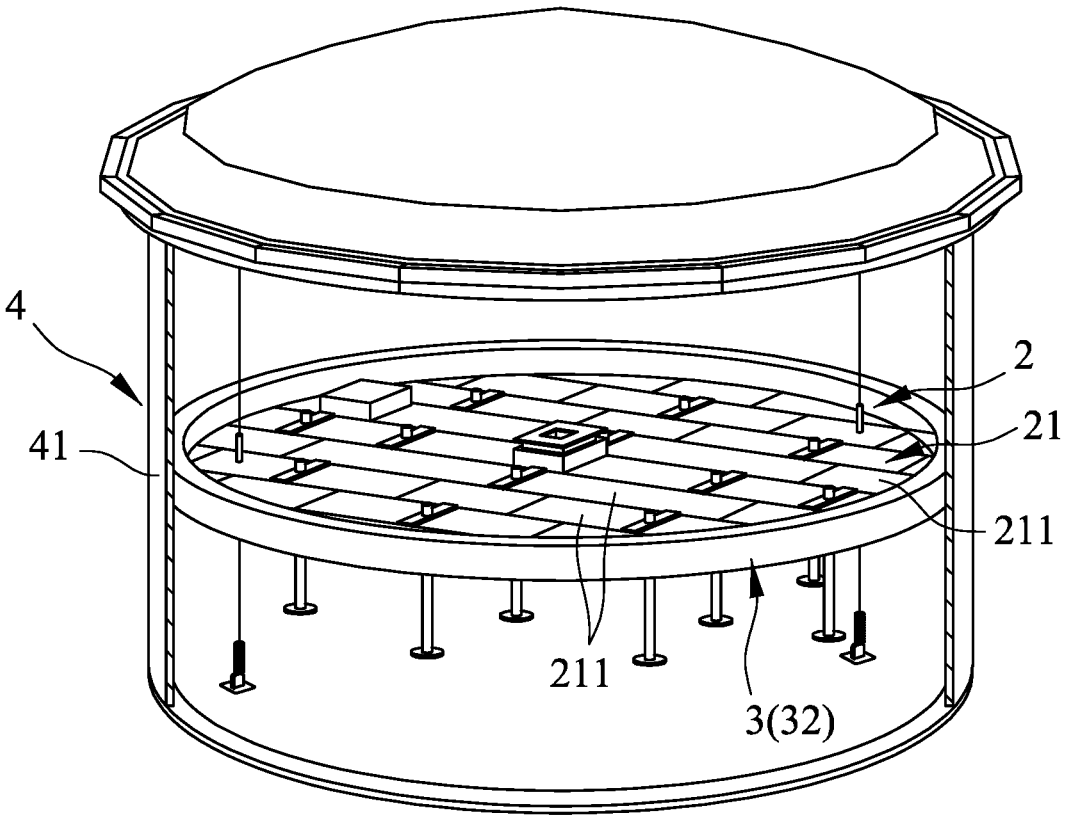
FIG. 2 illustrates a fluid tank incorporating an internal floating roof with a peripheral sealing assembly according to an embodiment of the disclosure.
Figure 3:
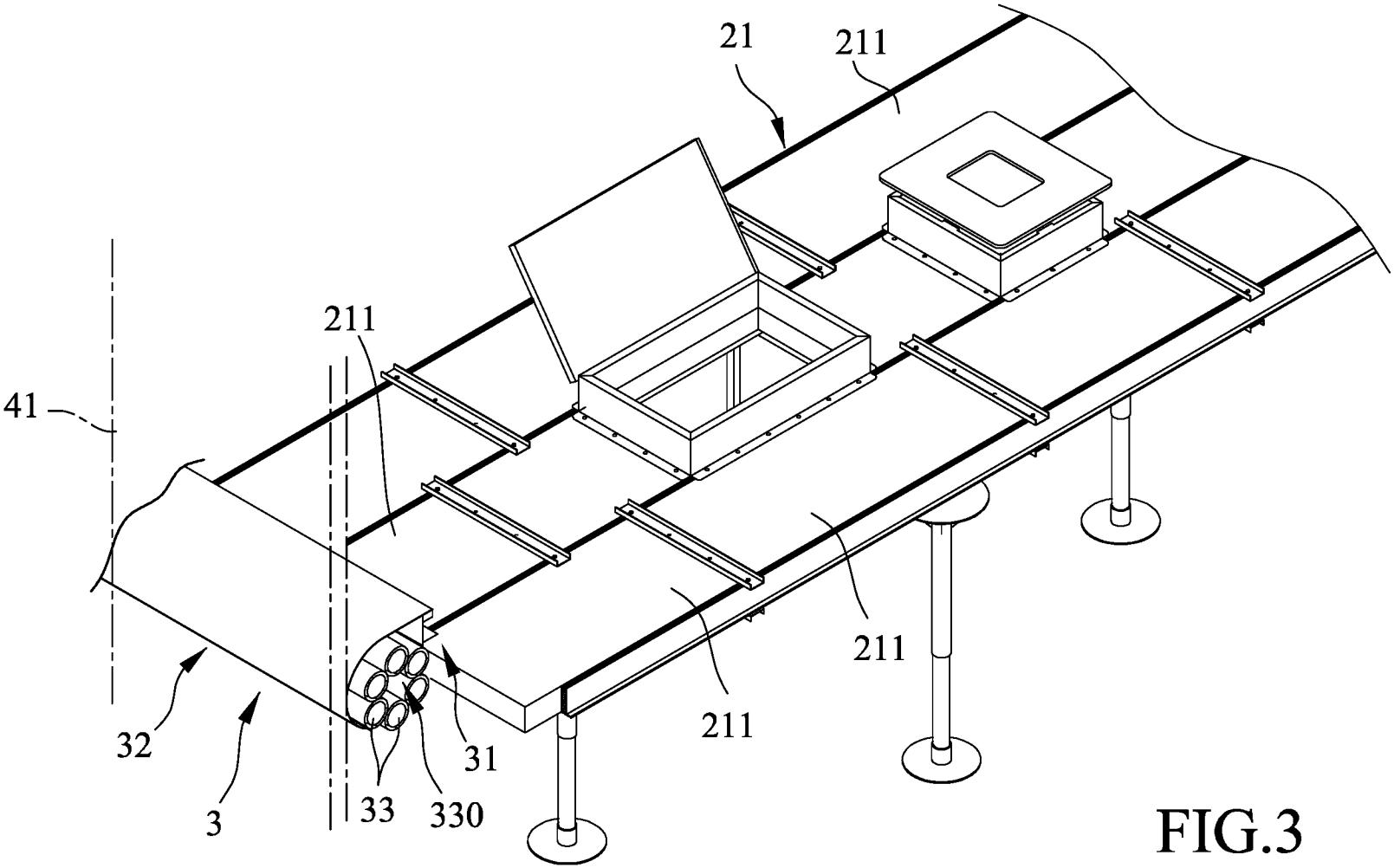
FIG. 3 is a fragmentary perspective view illustrating the peripheral sealing assembly of the embodiment in connection with a buoyant panel unit.
Figure 4:
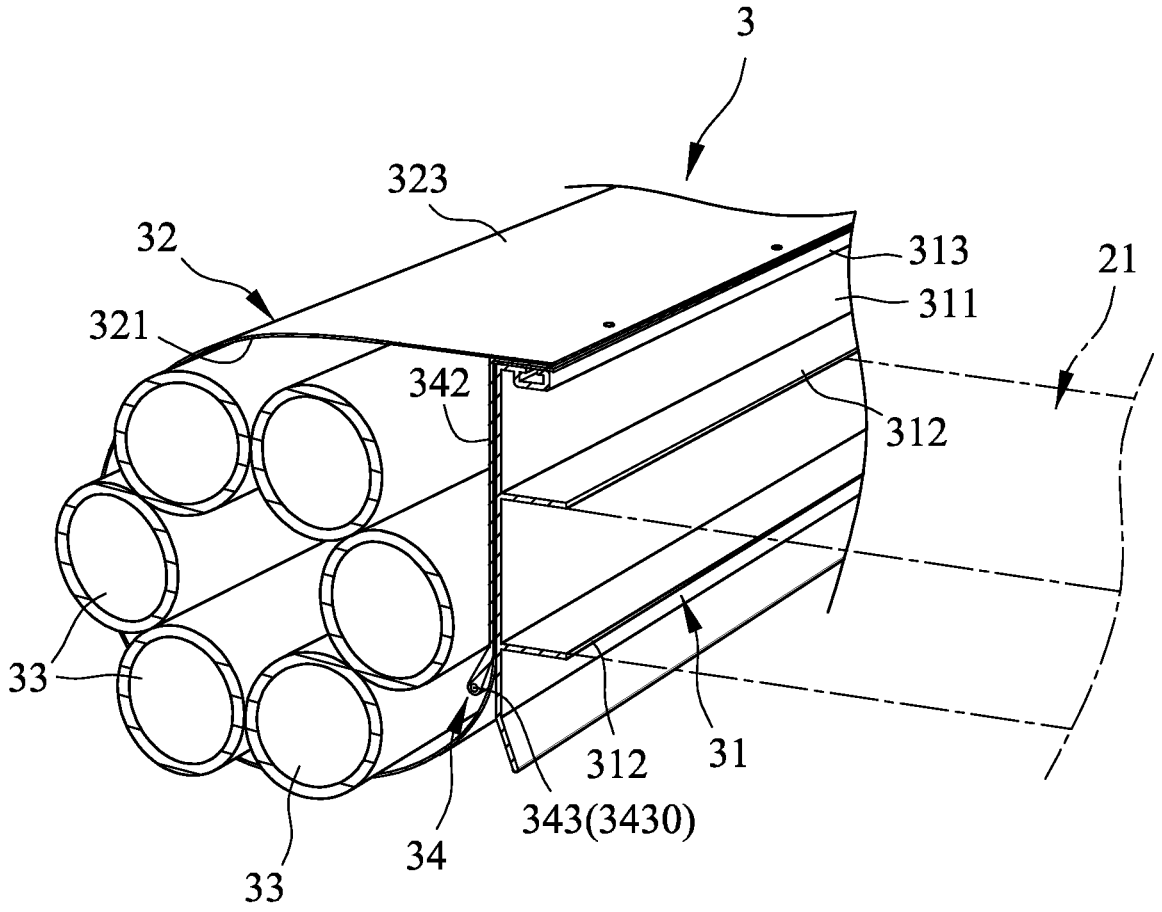
FIG. 4 is a fragmentary perspective view illustrating the peripheral sealing assembly of the embodiment.

FIGS. 2 to 4 illustrate a peripheral sealing assembly 3 according to an embodiment of the disclosure for connection with a buoyant panel unit 21 of an internal floating roof 2 usable in a liquid storage tank 4. The internal floating roof 2 is movable along with a liquid surface inside the liquid storage tank 4. The buoyant panel unit 21 is substantially rounded and is composed of a plurality of floating members 211 connected to each other. The peripheral sealing assembly 3 is interposed between an inner surrounding wall 41 of the liquid storage tank 4 and the buoyant panel unit 21. The peripheral sealing assembly 3 includes a fixing frame 31, an enclosure 32 and a plurality of juxtaposed buffer pipes 33.

Figure 5:
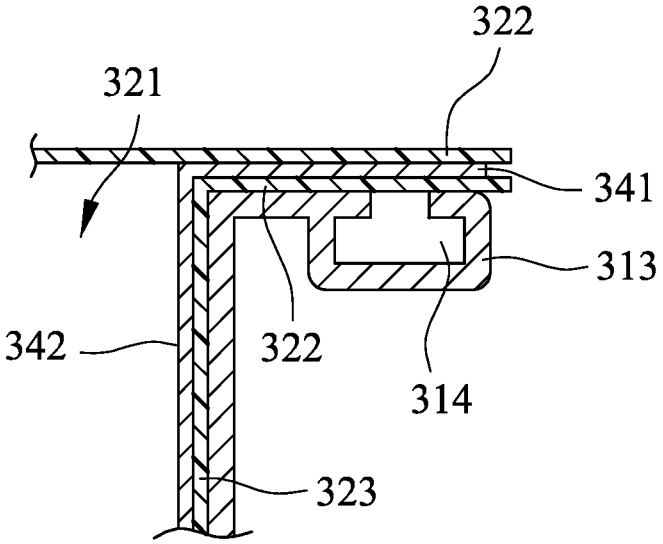
FIG. 5 is a fragmentary sectional view illustrating the peripheral sealing assembly of the embodiment.

Referring to FIG. 5 in combination with FIGS. 2 to 4, the fixing frame 31 extends around and connects a periphery of the buoyant panel unit 21. The fixing frame 31 has a main plate portion 311 that extends vertical and around the rounded periphery of the buoyant panel unit 21, two spaced-apart clamp plate portions 312 projecting inwardly from the main plate portion 311 to clamp the periphery of the buoyant panel unit 21, and a mounting portion 313 projecting inwardly from the main plate portion 311 above the clamp plate portions 312. The mounting portion 313 has an annular recess 314 that extends around the periphery of the buoyant panel unit 21 and that opens upward.

The enclosure 32 is fixed to the fixing frame 31 and sealingly contacts the inner surrounding wall 41 of the liquid storage tank 4. The enclosure 32 defines a looped receiving space 321 between the inner surrounding wall 41 and the buoyant panel unit 21. In this embodiment, the enclosure 32 has two end sheet portions 322, a folded sheet portion 323, and a press plate 34. The two end sheet portions 322 are fixed together to the mounting portion 313 of the fixing frame 31. The folded sheet portion 323 connects between the end sheet portions 322 and defines the looped receiving space 321. The enclosure 32 is made of a material that is resistant to oil and volatile organic substances and that has high abrasion resistance and high tensile strength.

The buffer pipes 33 are inserted into the looped receiving space 321 and are placed in side by side contact with each other. Each pipe 33 is hollow, extends along the looped receiving space 321, and is fixed to the lengthwise outer peripheral surfaces of two adjacent ones of the buffer pipes 33. In particular, the lengthwise outer peripheral surfaces of the buffer pipes 33 are adhesively connected to each other. The buffer pipes 33 cooperate to surround a hollow space 330 that extends along the looped receiving space 321.

Each of the buffer pipes 33 is made of a closed cell foam that is non-flammable, light and impermeable. As the closed cell foam has light weight, it can increase floatability. In addition, the closed cell foam does not easily break and disintegrate and can reduce the risk of contamination problem encountered in the prior art due to the use of a polyurethane (PU) foam that disintegrates easily.

In this embodiment, the enclosure 32 further has a press plate 34 disposed within the looped receiving space 321 and connected to the fixing frame 31. The press plate 34 has a fixed portion 341, a bent press plate portion 342, and an end plate portion 343. The fixed portion 341 is interposed between the end sheet portions 322 of the enclosure 32 and is fixed to the mounting portion 313 of the fixing frame 31 together with the end sheet portions 322. The bent press plate portion 342 extends from the fixed portion 341 into the looped receiving space 321 to press apart of the folded sheet portion 323 of the enclosure 32 against the fixing frame 31. The end plate portion 343 extends from the bent press plate portion 342 and has a receiving hole 3430 to receive a steel rope (not shown). The bent press plate portion 342 and the end plate portion 343 of the press plate 34 serve to position part of the folded sheet portion 323 of the enclosure 32 relative to the fixing frame 31. The steel rope (not shown) inserted into the receiving hole 3430 can prevent the press plate 34 from being pulled upward and deformed when the enclosure 32 moves relative to the liquid storage tank 4. Therefore, the sealing ability of the peripheral sealing assembly 3 may be stabilized.

As shown in FIGS. 4 and 5, the fixed portion 341 of the press plate 34 is sandwiched between the end sheet portions 322 of the enclosure 32, and they are fixed together by fasteners 5 (see FIG. 4). In this embodiment, multiple flexible nuts (not shown) of the fasteners 5 are disposed and positioned within the annular recess 314 of the clamp plate portions 312. Multiple bolts (not shown) of the fasteners 5 extend through the fixed portion 341 of the press plate 34 and the end sheet portions 322 of the enclosure 32 into the annular recess 314 and are respectively engaged with the flexible nuts, so that the enclosure 32 and the press plate 34 are fixed to the fixing frame 31.

Because multiple hollow buffer pipes 33 are received in the looped receiving space 321, and because the lengthwise outer peripheral surfaces of the multiple hollow buffer pipes 33 are juxtaposed and fixed to each other, the peripheral sealing assembly of the disclosure has improved deformable characteristics. The buffer pipes 33 can compensate each other to provide an improved squeeze damping effect as well as increased floating and sealing effects.

As shown in FIG. 4, while in this embodiment the number of the buffer pipes 33 is six and the buffer pipes 33 are arranged in a hexagonal array, the number of buffer pipes 33 may be three or more than three, and the buffer pipes 33 may be arranged in other polygonal patterns.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A peripheral sealing assembly for connection with a buoyant panel unit 21 of an internal floating roof usable in a liquid storage tank, comprising:

a fixing frame configured to extend around and connect a periphery of the buoyant panel unit;

an enclosure fixed to said fixing frame and configured to sealingly contact an inner surrounding wall of the liquid storage tank, said enclosure defining a looped receiving space; and a plurality of buffer pipes inserted into said looped receiving space, each of said buffer pipes being hollow, extending along said looped receiving space and having a lengthwise outer peripheral surface that is fixed to said lengthwise outer peripheral surfaces of two adjacent said buffer pipes.

2. The peripheral sealing assembly as claimed in claim 1, wherein said lengthwise outer peripheral surfaces of said buffer pipes are adhesively connected to each other.

3. The peripheral sealing assembly as claimed in claim 1, wherein the number of said buffer pipes is at least three, each of said buffer pipes being made of a closed cell foam.

4. The peripheral sealing assembly as claimed in claim 1, wherein each of said buffer pipes is made of a closed cell foam.

5. The peripheral sealing assembly as claimed in claim 1, wherein said enclosure is made of a material that is resistant to oil and volatile organic substances.

6. The peripheral sealing assembly as claimed in claim 1, wherein said enclosure has two end sheet portions fixed together to said fixing frame and a folded sheet portion connecting between said end sheet portions and defining said looped receiving space, said fixing frame having a main plate portion configured to extend around the periphery of the buoyant panel unit, two spaced-apart clamp plate portions projecting inwardly from said main plate portion to clamp the periphery of the buoyant panel unit, and a mounting portion projecting inwardly from said main plate portion above said clamp plate portions, said end sheet portions being fixed to said mounting portion.

7. The peripheral sealing assembly as claimed in claim 6, wherein said enclosure further has a press plate disposed within said looped receiving space and connected to said fixing frame, said press plate having a fixed portion interposed between said end sheet portions of said enclosure and fixed to said mounting portion of said fixing frame together with said end sheet portions, a bent press plate portion extending from said fixed portion into said looped receiving space to press a part of said folded sheet portion of said enclosure against said fixing frame, and an end plate portion extending from said bent press plate portion and having a receiving hole.

8. The peripheral sealing assembly as claimed in claim 1, wherein said buffer pipes cooperate to surround a hollow space that extends along said receiving space of said enclosure.

* * * * *